United States Patent [19]

Norton

[11] 4,008,109

[45] Feb. 15, 1977

[54] SHAPED HEAT INSULATING ARTICLES

[75] Inventor: Gerard Norton, Vancouver, Canada

[73] Assignee: Chemincon Incorporated, Southfield, Mich.

[22] Filed: July 1, 1975

[21] Appl. No.: 592,331

[52] U.S. Cl. ..... 149/37; 106/38.35; 252/62

[51] Int. Cl.[2] ..... C06B 33/00; B28B 7/28; C04B 43/00

[58] Field of Search ..... 149/37, 40, 41, 42–44; 252/62; 106/38.35, 38.6, 57, 59, 62, 69

[56] References Cited

UNITED STATES PATENTS

| | | | |
|---|---|---|---|
| 2,250,009 | 7/1941 | Coble | 149/37 |
| 2,276,671 | 3/1942 | Rentschler | 149/37 |
| 2,426,849 | 9/1947 | Udy | 149/43 |
| 2,591,105 | 4/1952 | Strauss | 149/43 |
| 2,798,818 | 7/1957 | Pletsch | 149/41 |
| 3,132,061 | 5/1964 | Walsh | 149/44 |
| 3,144,690 | 8/1964 | Buckingham | 149/41 |
| 3,162,558 | 12/1964 | Bishop | 149/42 |
| 3,172,795 | 3/1965 | Helliwell | 149/40 |
| 3,347,721 | 10/1967 | Jago | 149/37 |
| 3,802,970 | 4/1974 | Bishop | 149/37 |

FOREIGN PATENTS OR APPLICATIONS

| | | |
|---|---|---|
| 1,283,692 | 9/1969 | United Kingdom |

*Primary Examiner*—Samuel W. Engle
*Assistant Examiner*—Donald P. Walsh
*Attorney, Agent, or Firm*—Norris & Bateman

[57] ABSTRACT

A shaped heat insulating article for utilisation as a foundry riser sleeve, a ingot mould hot top lining, or the like comprises a granular and or fibrous refractory material which has a high infrared and ultra-violet radiation opacity, an exothermic mixture of a fuel and an oxidizing agent, and a binder and has a density below 0.7 grams per cubic centimeter.

12 Claims, No Drawings

SHAPED HEAT INSULATING ARTICLES

This invention relates to shaped heat-insulating articles for forming molten-metal-contacting linings for metallurgical moulds and in particular relates to preformed refractory boards, slabs or sleeves for use, for example, in lining hot tops (heads of ingot moulds) and risers in foundry moulds.

The purpose of providing a heat-insulating refractory lining in the hot top of an ingot mould or the riser of a foundry mould is to lower the rate of heat loss from the molten metal contained therein and to extend the solidification time of this molten metal beyond the time taken for the molten metal within the main body of the mould to solidify. A reservoir of molten metal is thereby provided in the hot top or riser which tends to prevent the formation of voids in the ingot or casting due to contraction thereof as it cools. In order to fulfil this purpose the lining may function simply as a heat insulator, that is a barrier which minimises the dissipation of heat from the hot top or riser, and such linings commonly comprise a granular refractory material, or a mixture of such materials, formed to the requisite self-supporting shape with the aid of a binder. It is known that the heat conductivity of such a refractory lining may be reduced by lowering the density thereof and one method of achieving this is to incorporate refractory fibrous material in the lining which results in a reduction in the density without unduly impairing the mechanical strength of the lining. U.K. Patent No. 1283692, for example, discloses a refractory heat-insulating composition which comprises aluminium, magnesium, silicon or zirconium in particulate form, alumino-silicate, zircon or silica fibrous refractory, and a binding agent comprising an organic binder and colloidal silica sol.

An alternative method of reducing the heat loss from a hot top or riser is to use an exothermic lining which contains a readily oxidisable inorganic material (hereinafter referred to as "fuel") and an exidising agent which react exothermically when the temperature of the lining is raised by molten metal in contact therewith. Powdered aluminium is a particularly suitable fuel but magnesium, ferrosilicon, silicon and calcium powders have also been suggested for this purpose. The exothermic reaction raises the temperature of such a lining throughout its thickness and ideally maintains the face of the lining remote from the face thereof in contact with the molten metal at a temperature equal or close to the temperature of the face in contact with the molten metal. Under conditions such as these there is negligible temperature difference across the lining and the lining approximates to a so-called isothermal barrier and there will be negligible heat loss across it. On termination of the exothermic reaction the heat loss across any given thickness of the lining will be largely dependent upon whatever heat insulation properties the lining, containing the burned out exothermic materials, may possess. At the present time the main criteria which are considered in the formulation of exothermic linings are the duration and intensity of the exothermic reaction and little attention has been given to the insulating properties on the termination of the exothermic reaction. Consequentially exothermic linings are generally dense bodies and are inferior from the purely heat-insulating viewpoint to the better beat-insulating (i.e. non-exothermic) linings.

It has been suggested that the greater the temperature difference across a heat insulating lining, or in other words the cooler the face of the lining remote from the surface which contacts the molten metal, then the higher the degree of heat insulation which will be provided. We have realised, however, and this forms the principle on which the present invention is based, that under certain conditions the converse of this is true, viz. that the lower the temperature difference across the lining the higher the heat insulation efficiency.

According to the invention a metallurgical heat insulating article for forming a molten-metal-contacting lining for metallurigical moulds comprises a granular and/or fibrous refractory material which has a high infra-red and ultra-violet radiation opacity, an exothermic mixture of a fuel and an oxidising agent, and a binder and has a density below 0.7 grams per cubic centimeter.

The exothermic ingredients in the lining result in the temperature of the lining increasing throughout its thickness and the face of the lining remote from the face thereof in contact with the molten metal approaches that of the face in contact with the molten metal and the temperature difference across the lining is reduced to a low value. In addition to its exothermic nature, however, the lining according to the invention is also rendered a good heat insulator and this is achieved by incorporating in the composition a refractory material which has a high opacity to infra-red and ultra-violet radiation, the thermal conductivity of a heat-insulator being dependent, inter alia, on the ease with which infra-red and ultra-violet radiation can penetrate it and be absorbed by the surrounding material. The thermal conductivity of infra-red and ultra-violet opaque materials varies only slightly with temperature and thus the increase in temperature of the lining due to the exothermic reaction results in only a slight increase in the thermal conductivity and the actual rate of heat loss, being proportional for a given thickness of material to the temperature difference across the lining and its thermal conductivity, is substatially reduced. This is in contradistinction to the situation obtained with materials of higher infra-red and ultra-violet transparency, such as silica, where the thermal conductivity increases substantially with increasing temperature and the benefits of reducing the temperature difference across the lining are significantly counteracted by the increase in the thermal conductivity. The exothermic reaction is further advantageous in that it reduces the time taken for the temperature gradient across the lining to reach a steady state, the heat transfer rate at steady state being less than the heat transfer rate under non-steady state conditions.

The heat-insulating properties of the lining according to the invention are further enhanced by the low density thereof which will not normally be outside the range of 0.25 to 0.55 grams per cubic centimeter and will preferably be within the range of 0.28 to 0.35 grams per cubic centimeter, with the most preferred range being 0.32 to 0.34 grams per cubic centimeter. The necessary low density can be obtained either by adding the refractory material to the composition, wholly or in part, in a fibrous form or by using a granular refractory material which is inherently of low density.

Suitable granular refractory materials include alumina, magnesia, chromite, titania, and zirconia or mixtures of two or more of these materials.

The preferred fibrous refractory is aluminosilicate fibre but other suitable materials are zircon, calcium silicate and alumina fibres or mixtures thereof. An advantage of the invention is that it is suitable for the production of linings where the use of asbestos as a fibrous refractory material is undesirable.

The preferred binder comprises an organic binder such as phenolic resins (for example phenol formaldehyde resin), urea based resins (for example urea formaldehyde resins), furan resins, or starch together with an inorganic binder which is preferably colloidal silica sol but which may be some other suitable inorganic binder such as mono aluminium orthophosphate or colloidal alumina.

The preferred fuel is aluminium powder which preferably has a particle size grading such that at least 99% by weight will pass through a 100 B.S.S. mesh sleve and at least 75% will not pass through a 270 B.S.S. mesh sleve and with substantially none of the powder passing through a 400 B.S.S. mesh sleve. It is well known that the rate at which the aluminium powder will ignite and its sensitivity, i.e. the speed with which ignition takes place, is dependent upon the fineness of the powder and in general the courser the powder the greater the proportion which needs adding to the composition. Other suitable fuels which may be used are ferro-silicon, silicon, magnesium or zirconium or mixtures of two or more of these materials.

Suitable oxidising agents, which are preferably water insoluble, include barium sulphate, iron oxide, manganese dioxide, barium nitrate or mixtures of two or more of these materials.

The composition of the lining preferably comprises a fluoride which acts as a catalyst for the exothermic reaction and suitable fluorides include cryolite, flourospar, sodium silico-fluoride or mixtures of two or more of these substances.

A heat insulating composition according to the invention preferably has the following composition by weight:

| | |
|---|---|
| Refractory material (granular and/or fibrous) | 20 – 80% |
| Fuel. | 10 – 40% |
| Oxidising Agent. | 0.2 – 20% |
| Fluoride. | 0.1 – 20% |
| Colloidal Silica Sol. | 0 – 20% |
| Organic Binder. | 0 – 10% |
| (The colloidal silica sol and the organic binder having a combined proportion in the range of 2 – 30%). | |

A heat insulating lining according to the invention still more preferably is of the following composition by weight:

| | |
|---|---|
| Refractory material (granular and/or fibrous). | 50 – 67.5% |
| Fuel. | 12.5 – 30% |
| Oxidising Agent. | 2 – 4% |
| Fluoride. | 0 – 2% |
| Colloidal Silica Sol. | 2 – 15% |
| Organic Binder. | 5 – 8.5% |

A lining according to the present invention is particularly suitable for use as a riser sleeve in the casing of iron and steel due to the high temperatures involved in the processing of these materials.

The preferred method of forming a lining according to the invention is to form an aqueous slurry of the composition, dewatering the slurry on a porous former of the required shape, and drying the shape so formed in an oven. A dispersing agent, such as aluminium sulphate or ferric chloride, may be added to assist the formation of the slurry.

The following examples are embodiments of the invention:

Example 1.

| | |
|---|---|
| Aluminosilica fibre. | 40.0% |
| Calcined magnesia (−100 + 400 B.S.S. Mesh) | 11.5% |
| Aluminium powder (−36 + 400 B.S.S. mesh) | 21.5% |
| Barium nitrate (−60 + 200 B.S.S. mesh) | 4.0% |
| Cryolite (−100 B.S.S. mesh) | 2.0% |
| Colloidal silica (30% solids) | 15.0% |
| Starch (pregelled partially cationic) | 3.0% |
| Phenol-formaldehyde two stage resin (cures at 150 – 180° C) | 2.0% |
| Ferric chloride | 1.0% |

Example 2.

| | |
|---|---|
| Aluminosilica fibre | 42.2% |
| Alumina (−100 B.S.S. mesh) | 7.0% |
| Titania (−100 B.S.S. mesh) | 7.0% |
| Aluminium (−200 + 400 B.S.S. mesh) | 21.0% |
| Barium nitrate (−60 + 300 B.S.S. mesh) | 2.0% |
| Sodium silico-fluoride (−100 B.S.S. mesh) | 1.0% |
| Colloidal silica (30% solids) | 12.0% |
| Starch | 4.5% |
| Resin | 2.5% |
| Aluminium suphate | 0.8% |

Example 3.

| | |
|---|---|
| Aluminosilica fibre | 45.8% |
| Alumina (−100 B.S.S. mesh) | 7.5% |
| Magnesia (−200 B.S.S. mesh) | 7.5% |
| Chromite (−200 B.S.S. mesh) | 6.7% |
| Aluminium (−300 B.S.S. mesh) | 12.5% |
| Barium sulphate (−100 B.S.S. mesh) | 2.5% |
| Cryolite (−100 B.S.S. mesh) | 1.0% |
| Colloidal silica (40% solids) | 10.0% |
| Starch | 3.5% |
| Resin | 2.0% |
| Aluminium sulphate | 1.0% |

Example 4.

| | |
|---|---|
| Aluminosilica fibre | 45.2% |
| Alumina (−100 B.S.S. mesh) | 5.0% |
| Aluminium (−36 + 200 B.S.S. mesh) | 27.5% |
| Barium sulphate (−100 B.S.S. mesh) | 4.0% |
| Colloidal silica (40% solids) | 2.0% |
| Starch | 3.5% |
| Phenol-formaldehyde two-stage resin cures at 150 – 180° C) | 2.0% |
| Aluminium sulphate | 0.8% |

Preformed shapes were made to the composition of the above four examples by the aforementioned slurry method and had densities of about 0.35 grams per cubic centimeter.

It should be noted that in this example the required low density is obtained by the use of a low density granular refractory and no fibrous refractory is added. A preformed shape was made to this composition by mixing the ingredients with 15 to 20% water to give a flowable mixture. This mixture was blown (or alternatively hand-rammed) into a suitable core box and was then stripped and dried at a temperature of 180°–190° C. The preformed shape had a density of 0.45 grams per cubic centimeter.

What I claim is:

1. In a shaped heat insulating article for forming a molten-metal contacting lining for metallurgical moulds or the like which comprises a refractory composite having a high infra-red radiation opacity and consisting essentially of an inorganic fibrous refractory material and a granular refractory filler material, an exothermic mixture of a fuel and an oxidising agent, and a binder; the improvement wherein said fibrous refractory material is a material selected from the group consisting essentially of aluminosilicate, zircon and alumina fibres and said shaped article has a density of about 0.25 to 0.55 grams per cubic centimeter.

2. A shaped heat insulating article according to claim 1 wherein the binder comprises an organic binder and an inorganic binder.

3. A shaped heat insulating article according to claim 2 wherein the organic binder is a material selected from the group consisting essentially of phenolic resins, furan resins and starch and the inorganic binder is a material selected from the group consisting essentially of colloidal silica sol, colloidal alumina, and mono aluminium orthophosphate.

4. A shaped heat insulating article according to claim 1 comprising a fluoride catalyst for the exothermic mixture.

5. A shaped heat insulating article according to claim 4 wherein the fluoride catalyst is selected from the group consisting essentially of cryolite, fluorspar and sodium silico-fluoride.

6. A shaped heat insulating article according to claim 1 preceding claims comprising the following composition by weight:

| | | | |
|---|---|---|---|
| Refractory material | 20 | to | 80% |
| Fuel | 10 | to | 40% |

-continued

| | | | |
|---|---|---|---|
| Oxidising agent | 0.2 | to | 20% |
| Fluoride catalyst | 0.1 | to | 20% |
| Colloidal silica sol | 0 | to | 20% |
| Organic binder | 0 | to | 10% |

The organic binder and colloidal silica sol having a combined proportion in the range of 2 to 30%.

The organic binder and colloidal silica sol having a combined proportion in the range of 2 to 30%.

7 A shaped heat insulating article according to claim 6 comprising the following composition by weight:

| | | | |
|---|---|---|---|
| Refractory material | 50 | to | 67.5% |
| Fuel | 12.5 | to | 30% |
| Oxidising agent | 2 | to | 4% |
| Colloidal silica sol | 2 | to | 15% |
| Organic binder | 5 | to | 8.5% |

8. A shaped heat insulating article according to claim 1 wherein the density thereof lies in the range of 0.28 to 0.35 grams per cubic centimeter.

9. A shaped heat insulating article according to claim 8 wherein the density thereof lies in the range of 0.32 to 0.34 grams per cubic centimeter.

10. The article defined in claim 1, wherein said granular material is one or more materials selected from the group consisting essentially of alumina, magnesia, chromite, titania and zirconia.

11. The article defined in claim 1, wherein the fuel is one or more materials selected from the group consisting essentially of aluminum, ferro-silicon, magnesium and zirconium powders.

12. The article defined in claim 11, wherein the oxidising agent is one or more materials selected from the group consisting essentially of barium sulfate, iron oxide, manganese dioxide and barium nitrate.

* * * * *

Notice of Adverse Decision in Interference

In Interference No. 100,366, involving Patent No. 4,008,109, G. Norton, SHAPED HEAT INSULATING ARTICLES, final judgment adverse to the patentee was rendered June 3, 1982, as to claim 1.

[*Official Gazette November 9, 1982.*]